US009945620B2

(12) United States Patent
Semmes

(10) Patent No.: US 9,945,620 B2
(45) Date of Patent: Apr. 17, 2018

(54) FREEZE DAMAGE RESISTANT WINDOW PERIMETER RADIATOR

(71) Applicant: Thomas Middleton Semmes, Millington, TN (US)

(72) Inventor: Thomas Middleton Semmes, Millington, TN (US)

( * ) Notice: Subject to any disclaimer, the term of this patent is extended or adjusted under 35 U.S.C. 154(b) by 373 days.

(21) Appl. No.: 14/614,142

(22) Filed: Feb. 4, 2015

(65) Prior Publication Data

US 2015/0144310 A1 May 28, 2015

Related U.S. Application Data

(63) Continuation-in-part of application No. 13/195,176, filed on Aug. 1, 2011, now abandoned.

(51) Int. Cl.

| | |
|---|---|
| ***F28F 7/00*** | (2006.01) |
| ***F28F 9/22*** | (2006.01) |
| ***F24F 1/00*** | (2011.01) |
| ***F28F 13/12*** | (2006.01) |
| ***F28F 21/06*** | (2006.01) |
| ***F28F 21/08*** | (2006.01) |
| ***F28D 7/02*** | (2006.01) |
| ***F28D 7/10*** | (2006.01) |
| ***F24D 19/00*** | (2006.01) |
| *F28F 19/00* | (2006.01) |
| *F28D 21/00* | (2006.01) |

(52) U.S. Cl.

CPC ..... *F28F 9/22* (2013.01); *F24D 19/0095* (2013.01); *F24F 1/0059* (2013.01); *F28D 7/026* (2013.01); *F28D 7/106* (2013.01); *F28F 13/12* (2013.01); *F28F 21/063* (2013.01); *F28F 21/088* (2013.01); *F28D 2021/0035* (2013.01); *F28F 19/00* (2013.01); *F28F 2265/26* (2013.01)

(58) Field of Classification Search

CPC ... F24D 19/0095; F24F 1/0059; F24F 1/0007; F24F 2001/0037; F24F 3/06; F24F 5/0003; F28D 1/0358; F28D 7/026; F28D 7/106; F28D 2021/0035; F28D 21/0012; F28F 9/22; F28F 13/02; F28F 13/12; F28F 19/00; F28F 21/063; F28F 21/088; F28F 2265/26

See application file for complete search history.

(56) References Cited

U.S. PATENT DOCUMENTS 2,060,936 A * 11/1936 Haag, Jr. ..... F28D 7/026 137/340
4,548,570 A * 10/1985 Hahn ..... B29C 47/0023 264/209.2
6,533,030 B2 * 3/2003 Mitrovic ..... F28F 1/40 138/38

* cited by examiner

*Primary Examiner* — Travis Ruby
(74) *Attorney, Agent, or Firm* — Mark S Hubert

(57) ABSTRACT

A room perimeter heating/cooling radiator with a non symmetrical elliptical transverse cross section, that utilizes low to medium temperature heat transfer fluid (generally water or water/glycol) in a new design with an enhanced 'primary only' heat transfer surface having an internal spiral or helix to circulate the water around the inside of the primary surface to enhance the heat transfer, and an internal conduit that provides both freeze damage protection and the ability to cross connect multiple identical radiators for increased efficiency. The primary intended location is within inches of the building windows.

9 Claims, 12 Drawing Sheets

FREEZE DAMAGE RESISTANT WINDOW PERIMETER RADIATOR

The following application incorporates by reference and is a continuation in part (CIP) of the CIP U.S. patent application Ser. No. 13/195,176 filed Aug. 1, 2011 entitled "ARCHITECTURALLY AND THERMALLY IMPROVED FREEZE RESISTANT WINDOW PERIMETER RADIATOR" which was a CIP of the parent U.S. patent application Ser. No. 11/595,382 entitled "ARCHITECTURALLY AND THERMALLY IMPROVED PERIMETER RADIATOR" filed Nov. 8, 2006.

BACKGROUND OF THE INVENTION

The present invention relates to a radiator for building heating and cooling, more specifically to a fluid media radiator designed for installation adjacent to a building window. It offers dramatic improvements in energy efficiency and appearance, and because of its location and lower temperature differential radiation, increases the usage of room perimeter space. The design has mechanical expansion tolerance resulting in protection from damage to the radiator caused by fluid freezing. The overarching concept is for the thermal losses or gains at the perimeter of a building (generally at the windows) to be addressed directly at their source, allowing the central heating and cooling systems to be dramatically downsized while incorporating freeze damage protection for the radiator.

Perimeter room heating is well known in such systems as hot water radiators, electric registers, and forced hot air systems. However, this is not the case for the cooling systems. Generally these ventilate cold air (not a fluid) through a centralized room location.

Radiators provide a combination of radiation and convection of thermal energy. These all suffer common drawbacks in that they occupy space at the floor-wall interface, and require additional room between adjacent furnishings to operate safely or at full efficiency. Additionally, they are located at some distance from the most common source of thermal loss (both hot and cold egress)—the windows. Thus, most require extreme differences between the heat transfer media (fluid or gas) and the ambient air for adequate thermal energy transfer. Since the driving force for the transfer of energy from the room heating/cooling system is a function of the differential between the surrounding air and the thermal source the most efficient system should be located as close as possible to the heat transfer ingress/egress source in the room. That would be the windows. Existing systems are near but not adjacent the windows. The present invention locates the heat transfer media at the window. In this way a lower temperature differential in the heat/cool transfer media (preferably water) located closer to the window can maintain the average room temperature as well as emit as much energy into a room as would a higher temperature differential source located further from the window.

A further problem with the prior art radiators, especially those that use water as the fluid heat transfer medium, is that in the event of an uncompensated cold ingress, the fluid heat transfer media can freeze, bursting the shell of the radiator or damaging any of the components contained therein the shell, and leading to disastrous flooding, or reduced efficiency.

This new design and physical relocation allows the present invention to be designed for application with moderate heat transfer media temperatures thus enabling much more efficient heating/cooling systems to be installed through the use of heat pumps, heat recovery, geothermal heat pump, solar hot water, geothermal hot water, ground source heat pump, and exhaust air energy recovery coupled with water-to-water heat pump.

Henceforth, the architecturally and thermally improved perimeter radiator fulfills a long felt need in the building heating/cooling industry. This new invention utilizes and combines known and new technologies in a unique and novel configuration to overcome the aforementioned problems and accomplish this.

SUMMARY OF THE INVENTION

The general purpose of the present invention, which will be described subsequently in greater detail, is to provide a new heating/cooling radiator that is able to maximize room perimeter usage and provide a level of efficiency with lower energy cost compared to existing, higher differential temperature heating/cooling systems. It has many of the advantages mentioned heretofore and many novel features that result in a new radiator which is not anticipated, rendered obvious, suggested, or even implied by any of the prior art, either alone or in any combination thereof.

In accordance with the invention, an object of the present invention is to provide an improved room perimeter radiator that is capable of providing a thermal barrier between occupant and window energy loss/gain.

It is another object of the present invention to provide a radiator that is designed for cross fluid connection to another identical radiator and that can withstand freezing of either of its fluids.

It is another object of the present invention to provide a radiator with the ability to compensate for the increase in volume of a contained fluid (such as freezing water) by mechanical expansion, therein preventing freeze damage to the radiator.

It is another object of the present invention to utilize an air to radiator heat transfer surface giving a high coefficient of heat transfer accomplished by a thin walled highly thermal conductive outer casing surrounding a spiral chambered vessel that increases the effectiveness across the heat transfer surface.

It is another object of the present invention to provide a radiator with an internal conduit that can freely pass through yet prevent a spiral insert that resides between the conduit's exterior and the interior of the heat transfer shell from deformation caused by the flow of the heat transfer fluid medium.

It is another object of the present invention for the spiral insert and conduit to be constructed of an elastically deformable material to provide freeze damage protection.

It is also a further object of the present invention to provide a radiator that can be coupled to an identical radiator with a cross connection of their heat transfer fluid medium and freeze damage resistant fluid medium, so that cross connection between the two can be enabled to increase the efficiency of the overall efficiency of the connected radiator pair.

It is another object of this invention to provide an improved radiator capable of cooling or heating a room by the transfer of thermal energy from or to a low pressure fluid medium.

It is a further object of this invention to provide a room perimeter heating/cooling radiator that is easily installed, compatible with a vast array of heating and cooling systems, and inexpensive to manufacture and has is resistant to damage cause by the freezing of the heat transfer fluid medium.

It is still a further object of this invention to provide for a room heating/cooling system that improves space comfort by minimizing temperature gradient within a room.

In the small part of the bearing there is a hole that accepts a nut.

It is yet a further object of this invention to provide a room perimeter radiator which will not hamper the placement of room furniture.

The new radiators utilize clean linear appearance with an internally enhanced primary only, heat transfer surface. These radiators have no unsightly exterior fins and avoid the unattractive, bulky look. The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
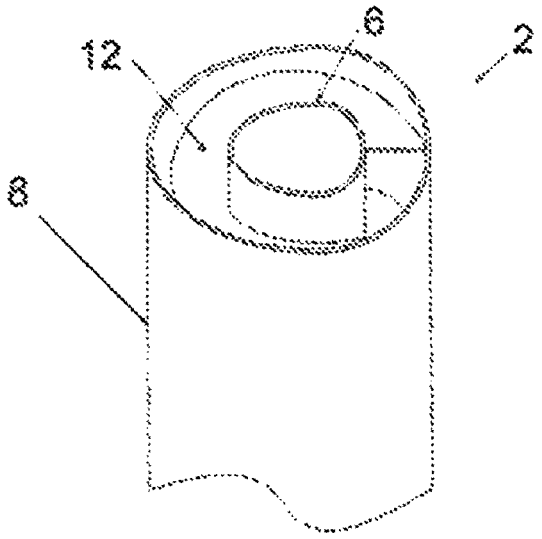
FIG. 1 is an end perspective view of the rounded (non symmetrical elliptical) radiator with an end cap removed and the core support partially extended.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

A "radiator" is type of heat exchanger wherein the energy (heat) transfer occurs at the exterior surface of the radiator and most commonly, the energy transfer medium external to the radiator is air.

A "rounded" configuration herein means a transverse cross sectional shape that is not circular, but rather forms a non symmetrical ellipse, including a "D" having two corners.

It is to be noted that the present invention is directed to use with water or a water/glycol mixture for the heat (energy) transfer first fluid as well as the freeze damage protection second fluid. These expand minimally from the density of their liquid phases when they freeze. Although it can be used with other mediums including those in a gaseous state, its freeze protection feature is lost with mediums that do not experience expansion in their solid state.

The present invention sets out a novel design wherein a radiant heat exchanger, transferring energy between the surrounding air and a heat (energy) transfer first fluid through the thin wall of a thermally conductive radiator shell, has an internal, mechanical freeze damage protection system, that incorporates a freeze damage protectant second fluid, a gas or elastically deformable foam, jell or similar medium, housed in an elastically deformable core tube (thermally insulated from the heat transfer fluid) as well as an elastically deformable free floating baffle housed between the radiator shell and the core tube. The design of the radiator allows for the coupling of two identical radiators and the cross connection of their first and second fluids to increase their overall heat transfer efficiency per unit length.

It is to be noted that the radiator is not "freeze proof." However, the radiator can undergo several freeze and thaw cycles without any mechanical damage to the radiator and its components. When the amount of heat energy transferred out of the volume of first fluid contained in the radiator shell causes the temperature of the first fluid in the radiator shell (water or a water based fluid in the preferred embodiment)

to drop below its freezing point, the first fluid will freeze solid and the radiator can be said to have "frozen." When the radiator freezes if the first fluid is water, the volume of the first fluid trapped within the radiator shell will expand approximately by 7%, bursting any round shell, partially detaching the radiator caps or fittings and/or deforming the baffle. It is not the act of freezing that the present device protects against. (There is negligible heat transfer between the second fluid and the first fluid as the core tube is thermally insulated.) Rather, the design and material selection of the baffle, the core tube and the radiator shell is such that they have enough elastic and non-elastic deformation, alone or combined, to accommodate this 7% increase in volume.

The mechanical expansion is accomplished by either or both of the core tube and the shell. The core tube elastically deforms or "crush" inward and accommodates some or all the extra volume for the expanding, frozen first fluid, thus minimizing the extra force exerted onto the radiator shell. Inside this core tube is a non frozen fluid (air, foam or jell) which can move to accommodate the reduction in the internal size of the core tube. The transverse cross sectional shape of the radiator shell is rounded but not circular. A shell with a circular transverse cross section cannot tolerate internal expansion because all the expansion forces are applied evenly to the inner surface attempting to expand the shell at every point. This results in a burst failure at the weakest point of the shell. The rounded shell (which has a non symmetrical ellipse or a D transverse cross sectional shape) being of a non symmetrical shape sees more pressure at different regions and thus non-elastically deforms in the region seeing the greatest pressure by bulging outward slightly. Without the full pressure caused by the freezing water being exerted at the weakest point of the shell, and deformation outward reducing the internal pressure, a shell failure is avoided mechanically.

The spiral fin of the baffle may be bent out of its helical configuration as the first fluid freezes, but because of its ability for elastic deformation, it will return to its original shape when the first fluid thaws, thus allowing the flow pattern of the first fluid to remain unhampered. Thus, this apparatus does not prevent or hamper freezing, but just prevents the freezing first fluid from damaging the radiator and its internal components. In a similar fashion, if the freeze damage protectant second fluid freezes, the core tube may bulge outward rather than splitting along its length or exerting pressure at its connection to the radiator end caps until they fail. Here again, freezing of the radiator can occur. Either of its first and second fluids can freeze without damage to the radiator. Hence the term "freeze damage resistant" radiator rather than "freeze proof" radiator or "freeze protected" radiator.

While existing prior art focuses on freeze protection through the application of internal or external heat to the heat transfer medium, the present invention provides a mechanical (rather than thermal) means of freeze damage protection. Simply stated, the core tube can elastically deform and alter its shape to accommodate some or all of the freezing volume changes within said first or second fluid chambers, and the shell itself can non-elastically deform to absorb the remainder of the freezing volume change if need be.

In the prior art there are heat exchangers/radiators that upon first view appear, other than the non circular transverse cross section, to be structurally similar to the present invention. They consist of circular transverse cross sectional shells or housings capable of accommodating the flow of a first fluid within a first chamber of the shell, and the flow of a second fluid within a second chamber of the shell (separated by a fluid proof barrier) and a fin disposed therein the first chamber. Such an example is the heat exchanger means of Haag U.S. Pat. No. 2,060,936. Generally these are circular in transverse cross section for ease of fabrication. The difference between these prior art devices is that their designs function around the transfer of thermal energy between the first and second fluids. They accomplish this using thermally conductive barrier materials between the two fluids (such as a thin walled metal pipe), and fins in contact with the surface of the barrier (either directly or with a backbone sleeve that snugly fits into contact over the barrier) to increase the surface are of heat transfer. The present device eliminates any thermal transfer between the fluids. The material chosen for the barrier and its thickness is selected to eliminate heat transfer. The fin therein is not in contact with the barrier of the shell, and exists to create turbulent flow within the first chamber not to aid in dissipating heat. To accommodate this, it utilizes a thermal energy transfer barrier (thermally insulated core tube) and an elastically deformable barrier. Generally this is a thick walled polymer tube. This allows the present device to withstand multiple freeze and thaw cycles of either of the fluids. Thus while at first blush the prior art appears to be structurally equivalent to the present invention, they are not. They are designed with different goals in mind, they cannot undergo freeing without structural damage, and they teach away from what the present invention seeks to accomplish.

The present invention relates to a heating/cooling radiator that dissipates or absorbs thermal energy via a heat transfer first fluid through a thin walled, finless shell of highly thermally conductive material. It is designed for the transfer of energy only between the radiator's first fluid and the surrounding air. It has a central linear core tube for the passage of a freeze protection damage second fluid (optionally air, foam or gel) at a different temperature than the first fluid. It is preferably mounted near the source of the energy surplus or deficit, like a perimeter wall window. It has an internal helix baffle that has a central linear bore that allows it to reside inside and unconstrained, about the freeze damage resistant core tube. In the event that enough energy is dissipated from the energy transfer media in the shell to the surrounding air to cause the media to freeze, the warmer fluid in the insulated core tube 6 will remain in the liquid state such that the core tube 6 can elastically deform so as to accommodate some or all of the additional volume of the freezing media in the shell without splitting the shell. The core tube 6 may also be of a rounded transverse cross sectional configuration, This shape allows the core tube to deform with less pressure that would be required if the core tube 6 had a circular transverse cross section.

The rounded shell allows for expansion deformation in specific designed regions to accommodate the remaining uncompensated for volume increase. as well (It is known that both the first and/or second fluid may be replaced with gasses as well.) For example in the configuration of a D with two squared corners the planer region bounded by the corners will deform first, bulging outward.

The internal helix baffle maintains turbulent rather than laminar flow throughout the shell to maximize media energy transfer with the shell. It is designed to be located adjacent to windows which are the source of entry for heat or cold into the building. In this way temperature compensation can be made closest to the need. This prevents large variances in room temperature and allows for heat/cold to be input to the room at a point where there exists the greatest temperature differential with the surrounding air. This large differential accommodates such a high efficiency of heat transfer, that a lower temperature heat transfer media (generally water) can accomplish what heretofore required much hotter media.

In the event of a failure of the heat source for the heat transfer fluid, the inner core tube has the ability to elastically deform (crushing inward or bulging outward) to accommodate the expansion of freezing fluid whether in the core tube 6 first or the shell 8 first.

While this present invention is designed for use with heat pumps, geothermal hot water, geothermal heat pumps, natural gas heated water and electrically heated water systems, the ability to use solar heated water is not precluded. The moderate water temperatures and moderate surface temperature shall allow furniture to be placed in extreme close proximity to the radiator.

Figure 2:
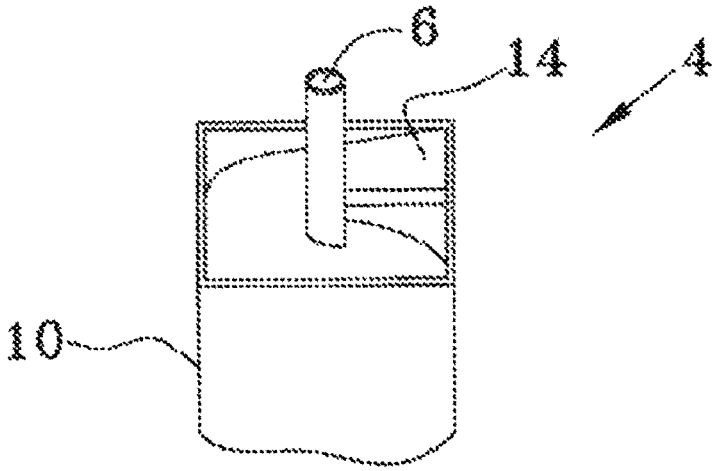
FIG. 2 is an end perspective view of the square radiator with an end cap removed and the core support partially extended.

Looking at FIGS. 1 and 2 the components and assembly of the round radiator 2 and the square radiator 4 can best be seen. Here the end caps 18 are removed and the core tube 6 withdrawn and slightly extended beyond the end of the radiator's finless tubular round shell 8 or finless tubular square shell 10. Thin walled highly thermally conductive materials chosen from the set of material of aluminum, brass, copper, bronze, steel or metal alloys, are the preferred materials for shell construction. The thickness of the shell wall is minimized and need only to be able to withstand the operating pressure of the system (which will be dictated by the setting of the system's relief valve) plus the regulatory safety margin requirement. Extremely malleable radiator shells like ones made of ductile copper, offer excellent deformation and not splitting properties. Since the operating pressures are low (less than 130 psi in the preferred embodiment) the wall thickness of the shell to provide for a safety margin working pressure of 400 psi, generally will be in the range below that of Schedule 5. Preferably, for core tubes having a nominal outer diameter of 1-3 inches this corresponds to a min wall thickness in the 0.012 to 0.033 inch range, or a wall thickness that is approximately 1% of the actual outer diameter of the tubing or pipe for the shell materials specified herein. The radiator shells are thin wall hollow linear members, rounded but not circular in cross section, that have a thermally insulated central core tube 6 (generally of a polymer material) and an internal helix baffle 12 or 14 (also rounded but not circular when viewed down its linear axis), that resides between the core tube 6 and the shell 8. This baffle 12 is of a one piece (unitary) fabrication and is supported by the core tube 6 to ensure it's correct placement within the shell 8 and to prevent it's sagging, or compression toward the distal or proximate end of the shell 8. The helix baffle is not physically connected to the primary heat transfer surface, which is the shell 8. It maintains a slight gap 99 between its helical edge and the radiator shell and its inner helical edge and the core tube as well as all other components of the radiator. Since it is rounded not circular in transverse cross section, it will not rotate with the flow of the heat transfer first fluid and it's rotation need not be constrained by either of the end caps to prevent excessive movement within the shell.

Although discussed in non-symmetrical elliptical transverse cross sectional configuration, the radiator shell, core tube and baffle may also be "D" shaped. The advantage of this "D" shape is that additional freeze damage protection is inherent in the configuration as there is more room for elastic deformation in the flat sides of the shell and the core tube.

For the freeze damage protection to work, this requires that there is a small gap 99 between the baffle 12 and the core tube 6 to accommodate the changes in the core tube's diameter and shape when freeze damage protection occurs. The baffles are matingly conformed to the geometry of the tubular shell in which they reside. The helical configuration of the baffles impart an internal spiral of fluid circulation (turbulent flow) around the inside of the shell. The dimensional tolerances of the helix baffle are such that the vast majority of the heat transfer first fluid must undergo this turbulent flow as it traverses along the length of the shell.

The core tube 6 may be made of polyvinyl chloride (PVC), chlorinated polyvinyl chloride (CPVC) or copper pipe, as these have adequate thermal insulating properties when utilized in an appropriate wall thickness, however in the preferred embodiment it is fabricated from a cross-linked high density polyethylene (HDPE). The baffles 12 in the preferred embodiment are also made from the same material as the core tube 6 so as to enable elastic deformation as discussed herein. The core tube is thermally insulated so as to minimize energy transfer between the fluid in the shell and the fluid in the core tube. This is a critical feature not found in the prior heat exchanger or radiator designs. The prior art heat exchangers are designed for the transfer of energy between the two separated fluids within the heat exchanger. Hence, any fin must be in direct contact with the surface of the heat transfer surface to increase the transfer of heat energy. In this present design, energy transfer between the middle fluid and the core is not sought and is counter productive. Simply stated, it defeats the purpose of the apparatus. The freeze damage protection is lost if heat transfer between the first fluid and the second fluid can occur. In this apparatus, the second fluid exists for two purposes. First, to enable freeze damage protection, and second, in specific configurations involving connected heat exchangers with two fluids flowing therein, to increase the linear efficiency of the energy transfer for the conjoined radiators. This is accomplished through cross connection of the first and second fluids (as explained and shown in FIG. 17). This results in a more even heat profile across multiple connected radiators. Additionally, this insulation prevents the fluid in the core tube 6 and the fluid in the shell 8 from freezing simultaneously and rendering the freeze protection useless. Utilizing a high thermal conductivity material for the shell 8 and a low thermal conductivity material for the core tube 6 allows the freeze protection to work. The thermal insulation of the barrier between the first fluid and the second fluid (to prevent energy transfer between them) is accomplished by the selection of a material for this barrier that has a low coefficient of heat transfer and making the barrier of a thick enough amount of this material to allow a negligible amount of energy in the form of heat to cross this barrier. The preferred embodiment material for the core tube 6 is a high density polyethylene that contains cross-linked bonds in the polymer structure, changing the thermoplastic to a thermoset. Cross-linking is accomplished during or after the extrusion of the tubing. It has a thermal conductivity at 25 degrees C. in the range of 0.48-0.51 (W/(m k)). Aside from it's excellent flexibility and longevity, this selection of material also works well with natural gas and petroleum products as well as water and other chemical solutions. Core tubes 6 made of this material will allow water-filled radiators to endure five or six freeze-thaw cycles without splitting as it has elastic deformation properties (albeit for a limited number of freeze/thaw cycles). Since there will be primarily water passing through and around the core tube 6 the high density polyethylene of the preferred embodiment has an EVOH oxygen diffusion barrier that prevents oxygen from permeating into the core tube 6. The EVOH oxygen barrier includes a thin layer of ethylene vinyl alcohol (EVOH)

applied to the outside of the tubing during the extrusion process. EVOH is highly resistant to the passage of oxygen. Oxygen within the water is what causes rust in all the major metal components of a fluid circulating system including the boiler, circulators and valves. Using core tubes 6 with an oxygen diffusion barrier will enhance the life of the system components especially when the system is used primarily for radiant heat transfer. The core tube 6 material in the preferred embodiment meets ASTM F876 and ASTM F 877 standards. The oxygen diffusion barrier in the preferred embodiment meets German DIN 4726 standard. The core tubes 6 are of a sufficient wall thickness to thermally insulate the first fluid circulating about the baffle 12 and the second fluid traveling down the center of the core tube 6 from transferring any significant amount of thermal energy between them. In the preferred embodiment using high density polyethylene with cross-linked bonds in the polymer structure, (utilizing water or water glycol mixtures for the heat transfer first fluid) the amount of thermal insulation required in the first fluid specified operating range of 90-130 degrees F., corresponds to a core tube wall thickness of that is between 10% and 13% of the outside diameter of the core tube 6 with 10% being the minimum acceptable wall thickness. If other materials capable of sufficient elastic deformation are used for the core tube 6, these wall thickness ratios may be different and determined by the thermal conductivity of that material.

Generally, the wall thickness of a pipe or tubing is determined by the operating pressures of the media therein. Since the present invention is designed to operated at low pressures, the normal convention would be to use thin walled material for the core tube. However, to accomplish the thermal insulation, thick walled tubing would be required. Although it is specified in the preferred embodiment (with the preferred embodiment operating temperature range listed above) that the wall thickness would lie in the range of 10 to 13% of the tube diameter, this ratio varies based on a function of the temperature differential across the thermal barrier (core tube), and as a rule of thumb, can best be approximated as a minimum schedule 80 wall thickness in the temperature.

Although the high density polyethylene core tube wall thickness disclosed herein is suitable to provide the level of thermal insulation for window perimeter uses, it is also know that for other thermal energy transfer media and for operation at elevated pressures and temperatures, an additional insulation around the core tube 6 may be necessary.

Figure 3:
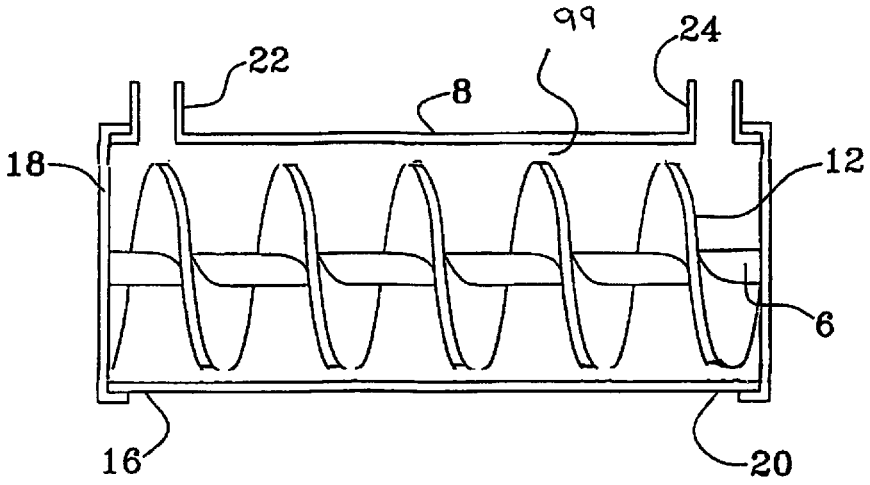
FIG. 3 is a side cross sectional view of the round radiator with side fluid fittings.
Figure 4:
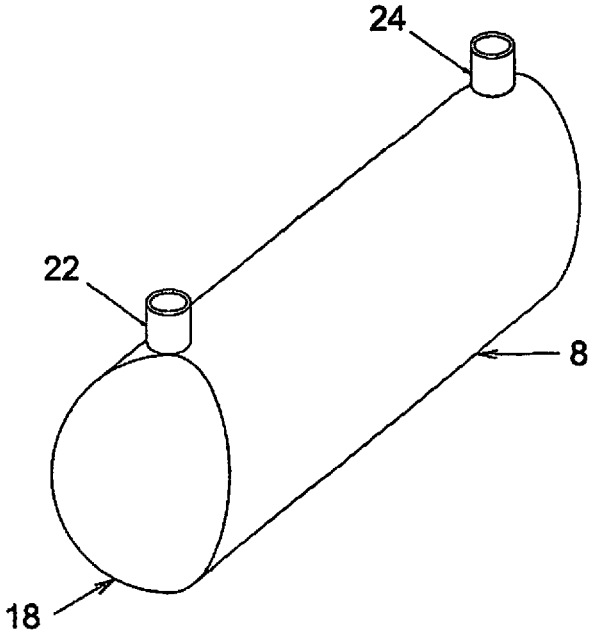
FIG. 4 is an end perspective view of the rounded (non symmetrical elliptical) radiator with side fluid fittings.

Looking at FIG. 3 the assembled rounded radiator 2 can best be seen. The rounded shell 8 is sealed at its distal end 16 and proximate end 20 by rounded end caps 18. (For ease of installation each of the end caps may be removable, however there need only be one removable end cap provided the other end is closed or the end cap is permanently affixed to the shell.) Heat transfer fluid medium enters and exits the radiator 2 through inlet fitting 22 and outlet fitting 24. As illustrated in FIG. 4 the fittings may be mounted on the outside surface of the shell 8. (When this type of fitting configuration is used, both the inlet and outlet fittings generally are on the same side of the shell.) Placement of the fittings may also be on the end caps. The difference between fittings on the end of the shells and fittings on the side of the shells is driven by the particular physical installation and application at hand. Either of the non-symmetrical elliptical shell 8 or the square shell 10 may have either side fluid fittings or end fluid fittings.

Figure 5:
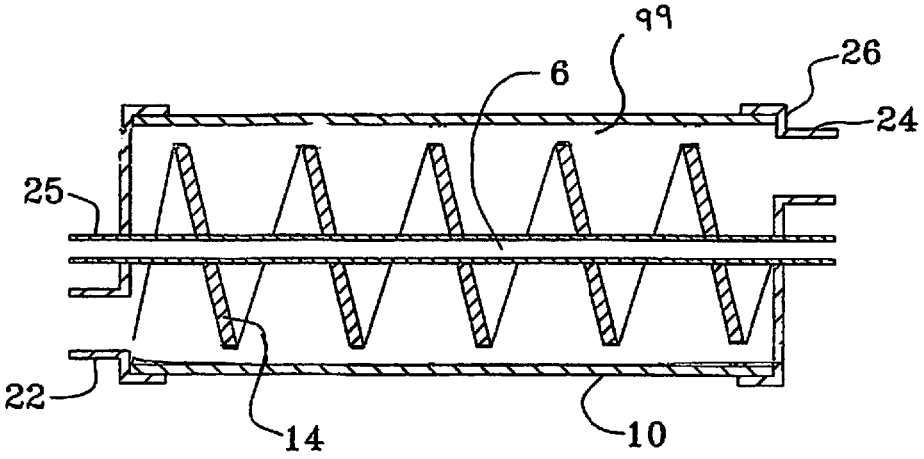
FIG. 5 is a side cross sectional view of the square radiator with dual end fluid fittings.
Figure 6:
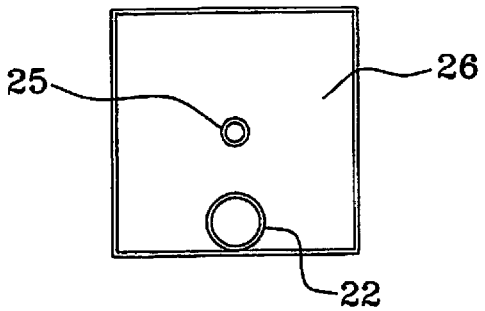
FIG. 6 is an end view of the square radiator with dual end fluid fittings.

FIGS. 5 and 6 show the assembled square radiator 4 but with dual end fittings. Inlet fitting 22 and outlet fitting 24 are installed on square end caps 26 as well as hollow core tube fittings 25. This inlet and exit fitting placement allows for the horizontal coupling of two or more radiators 4 with a single supply of heat (energy) transfer first fluid in a manner that allows for substantially similar energy transfer from each of the radiators. In this coupling the energy transfer medium enters inlet fitting 22 as well as core tube fitting 25. The majority of energy transfer in the first radiator is done by the fluid that passes through the helix baffle 12. The energy transfer media that passes through the hollow center of core support 6 retains much of its thermal energy as it traverses the length of the first radiator 4. At the junction of the two radiators, the outlet fitting 24 of the first radiator is connected to the core support fitting 25 of the second radiator and the core support fitting 25 of the first radiator is connected to the inlet fitting 22 of the second radiator. This crossover connection allows for substantially similar energy transfer along the linear length of the two coupled radiators.

Figure 17:
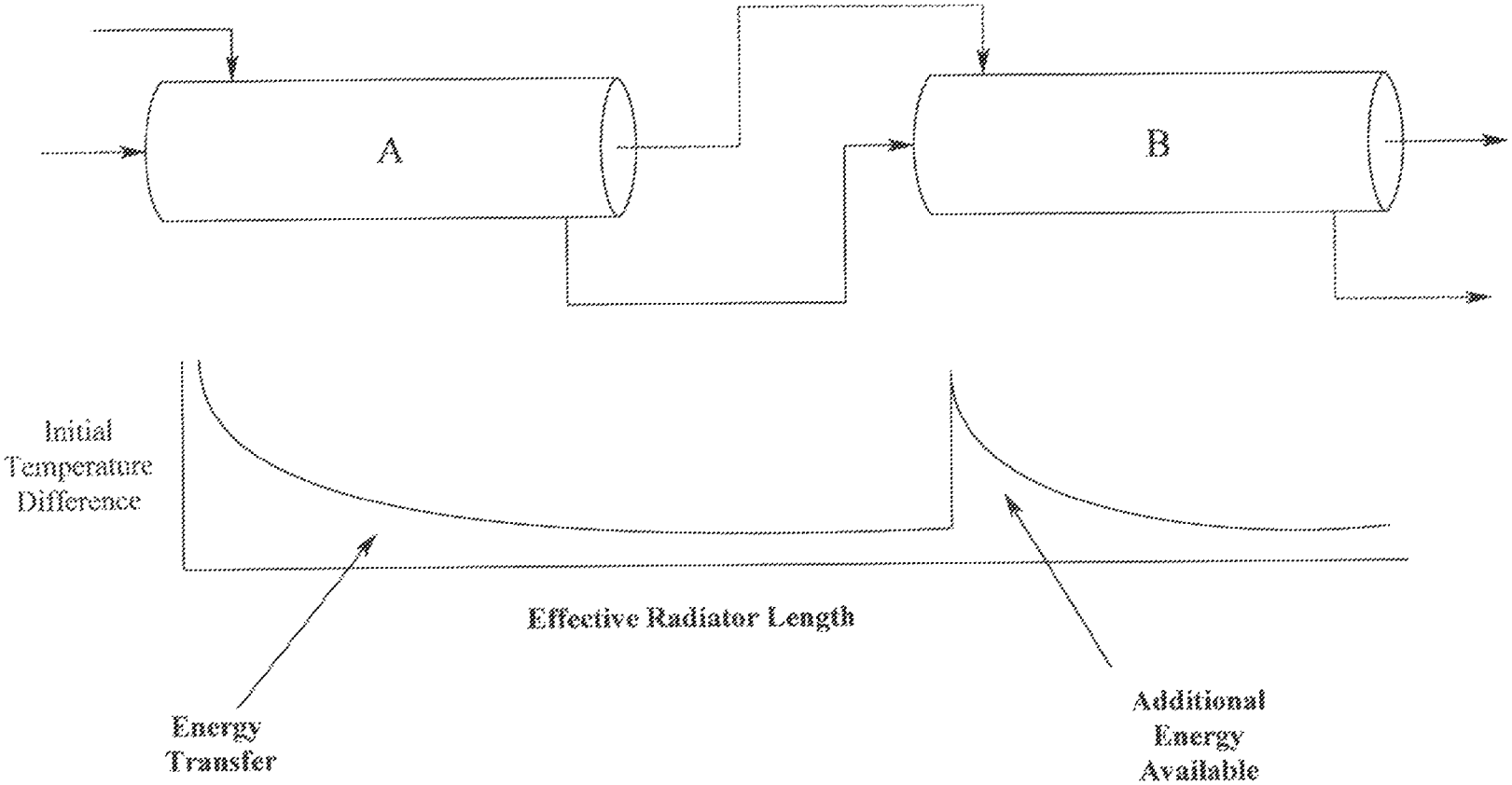
FIG. 17 is a representative view of two cross flow connected radiators and their energy transfer graph.
Figure 18:
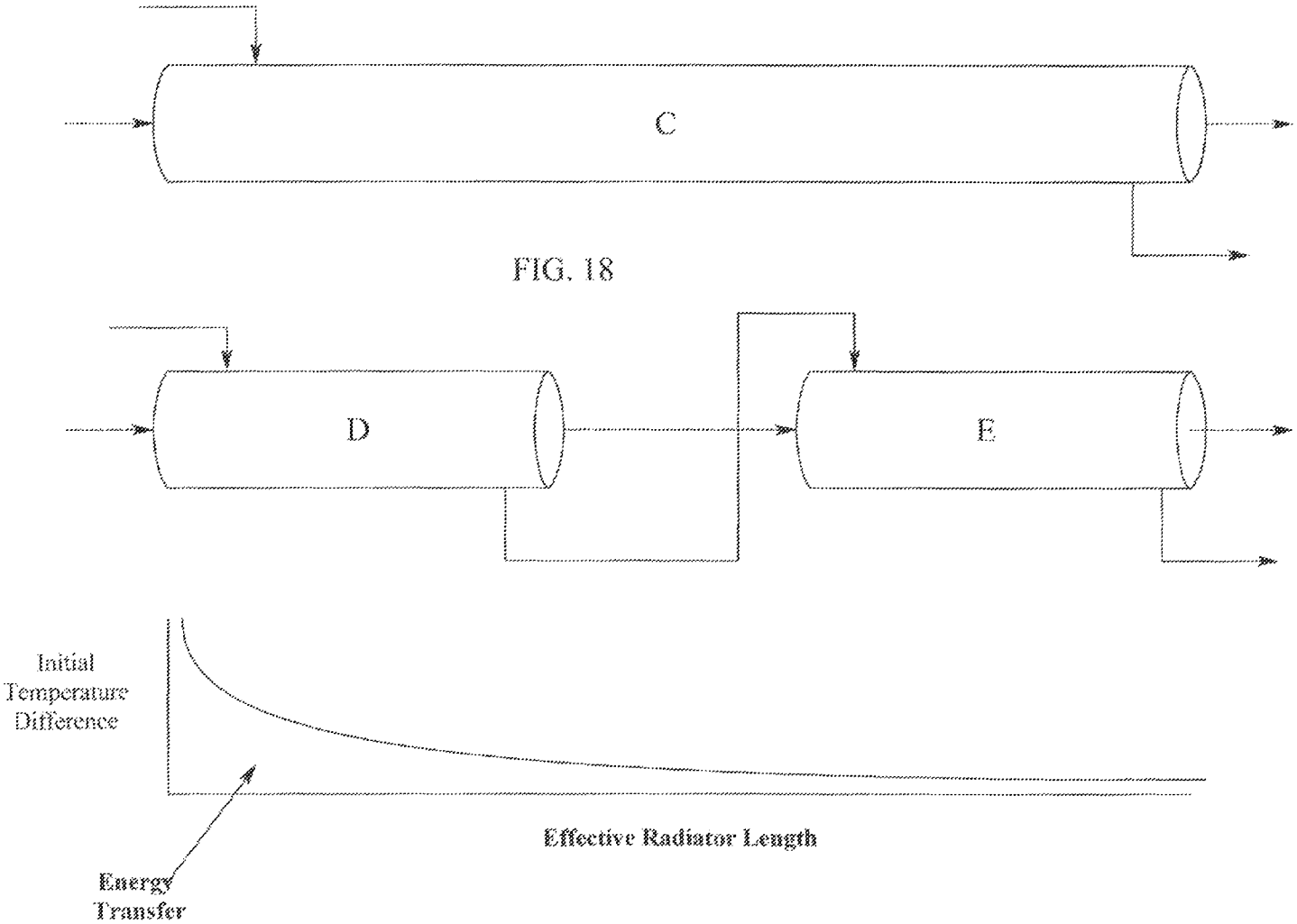
FIG. 18 is a representative view of two conventional cross flow connected radiators, an elongated radiator and their common energy transfer graph.

Looking at FIG. 17, a representative view of two cross flow connected radiators (A and B) and their energy transfer graph, and FIG. 18, a representative view of two conventional cross flow connected radiators (D and E), an elongated radiator (C) and their common energy transfer graph, it can be seen that when utilizing a single energy transfer medium with cross flow connected radiators there is an additional energy available for release as compared to a equivalently sized radiator or series of radiators.

Figure 7:
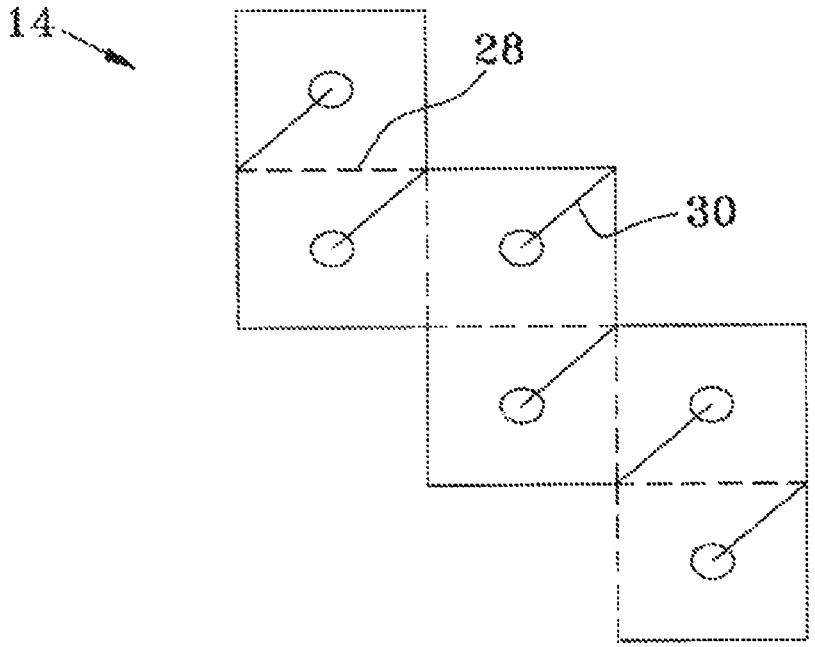
FIG. 7 is a fabrication layout pattern for the square internal spiral baffle core.
Figure 8:
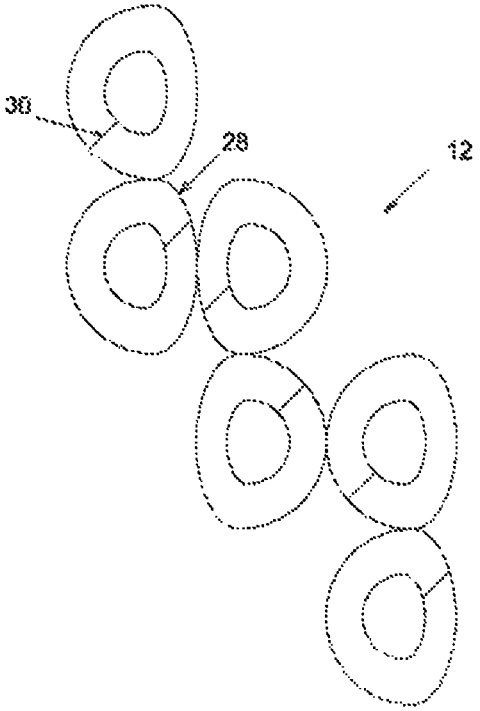
FIG. 8 is a fabrication layout pattern for the rounded (non symmetrical elliptical) internal spiral baffle core.

FIGS. 7 and 8 illustrate the fabrication and assembly layout for the square helix baffle 14 and the non symmetrical elliptical helix baffle 12. The dotted fold lines 28 indicate where the physical folds must be made between the individual planar elements to form the helix units, and the cut lines 30 indicate where cuts must be made in the individual planar elements so as to direct the helical flow of the heat transfer fluid within the radiator shell.

Figure 9:
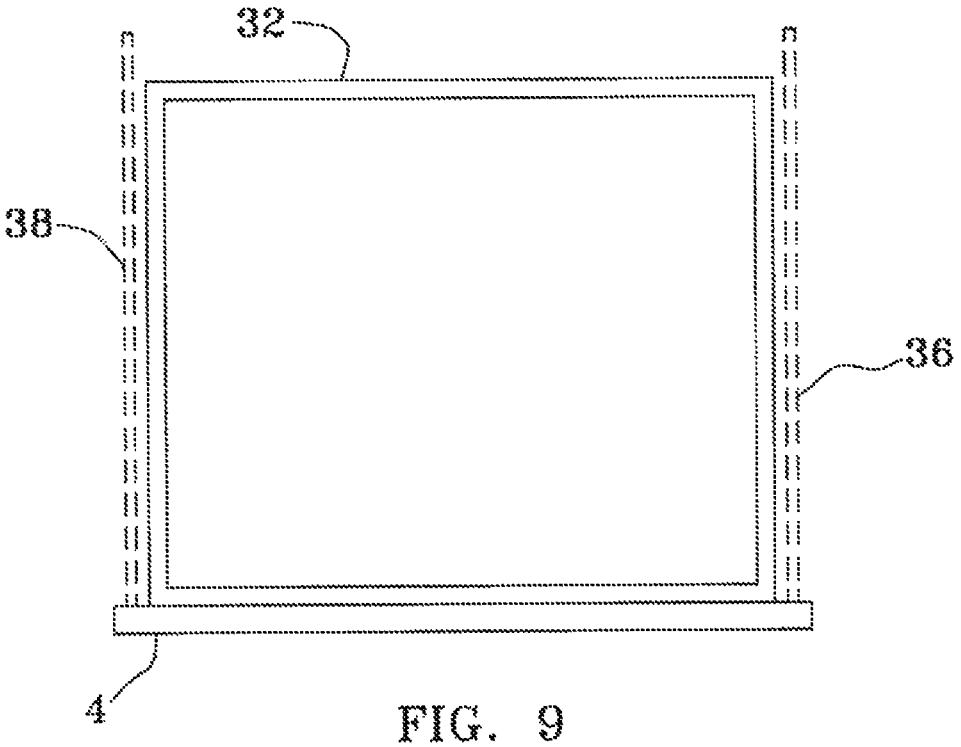
FIG. 9 is a front view of a square radiator with side fluid fittings installed at a window sill.
Figure 10:
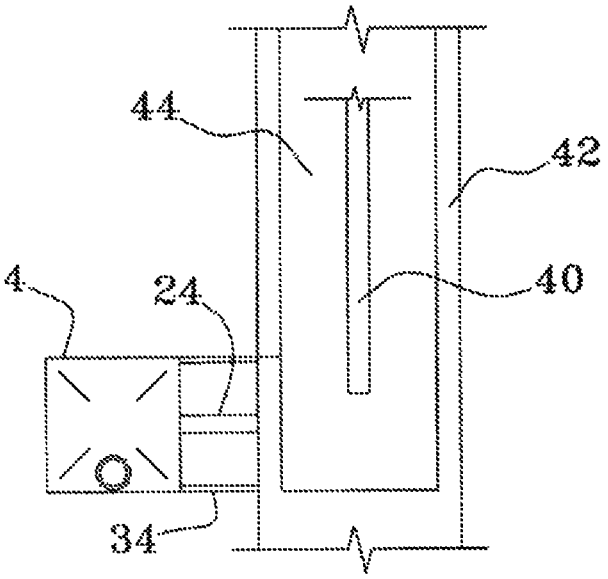
FIG. 10 is a cross sectional view of a radiator with side fluid fittings installed at a window sill.

FIGS. 9 and 10 show a square radiator 4 with side fluid fittings 24 installed with a simple bracket 34 adjacent to a window 32 so as to appear to be the window sill. The inlet line 36 and outlet line 38 are located in the walls 42 abutting the window 32. The window 32 is comprised of a frame 44 that retains a pane of glass 40. The radiator for this application (whether rounded or square) resides approximately one to three inches from the wall. Window mounted radiator units shall have an appearance similar to the window mullions or window sills. Window units are intended to offset window losses. Multiple radiators may be required if the ingress or loss of heat at the window is large. Window mounted radiators shall have estimated depth of 2 or 3 inches.

Figure 11:
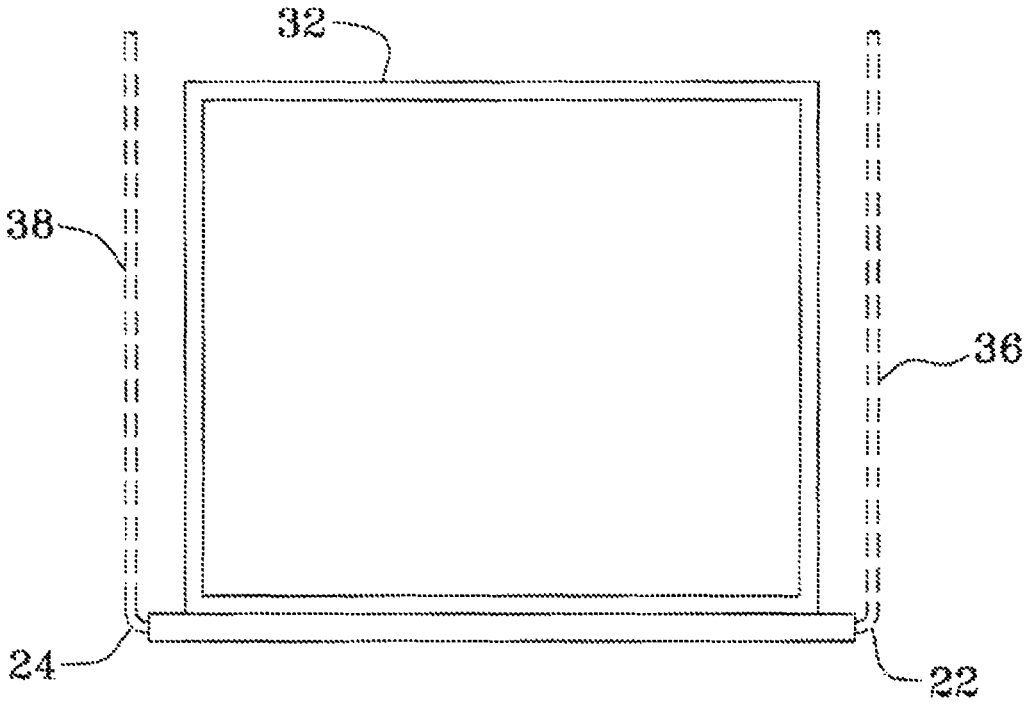
FIG. 11 is a front view of a square radiator with end fluid fittings installed at a window sill.
Figure 12:
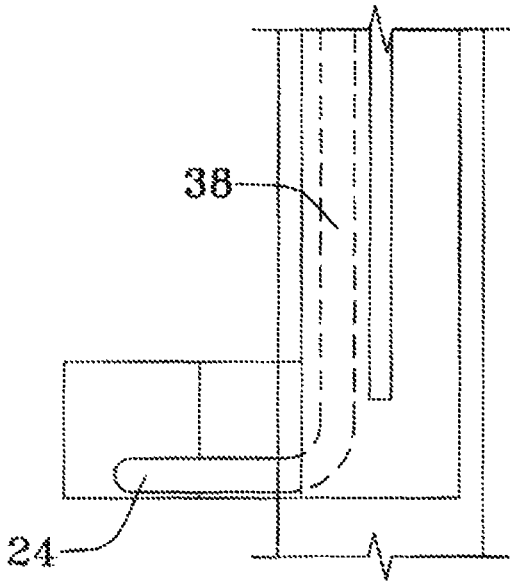
FIG. 12 is a cross sectional view of a radiator with end fluid fittings installed at a window sill.

FIGS. 11 and 12 show the use of a square radiator 4 that has fluid fittings installed in the end caps. These may be necessary depending upon the location of the heat transfer fluid system or because of the studding layout around the window.

Figure 13:
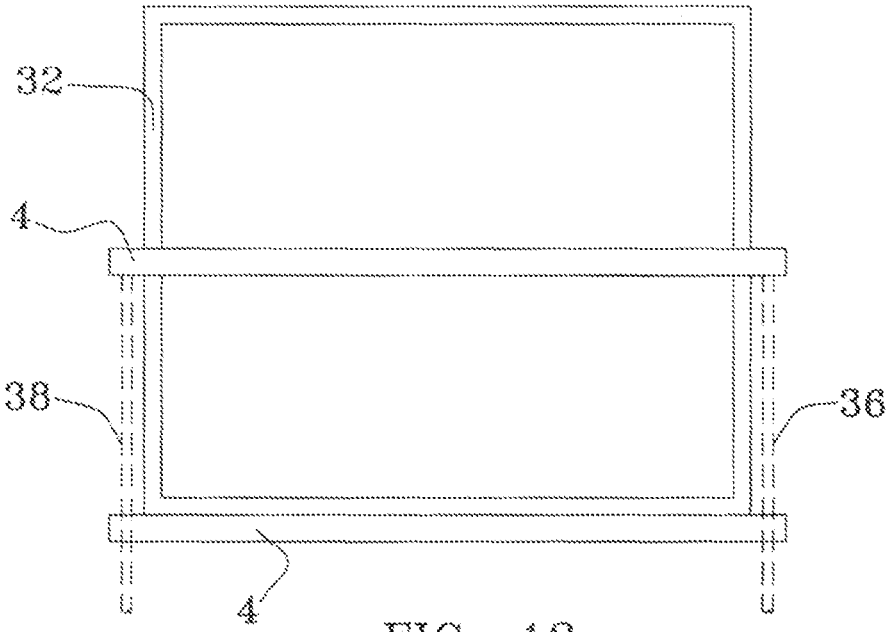
FIG. 13 is a front view of a two square radiators with side fluid fittings installed at a window sill.
Figure 14:
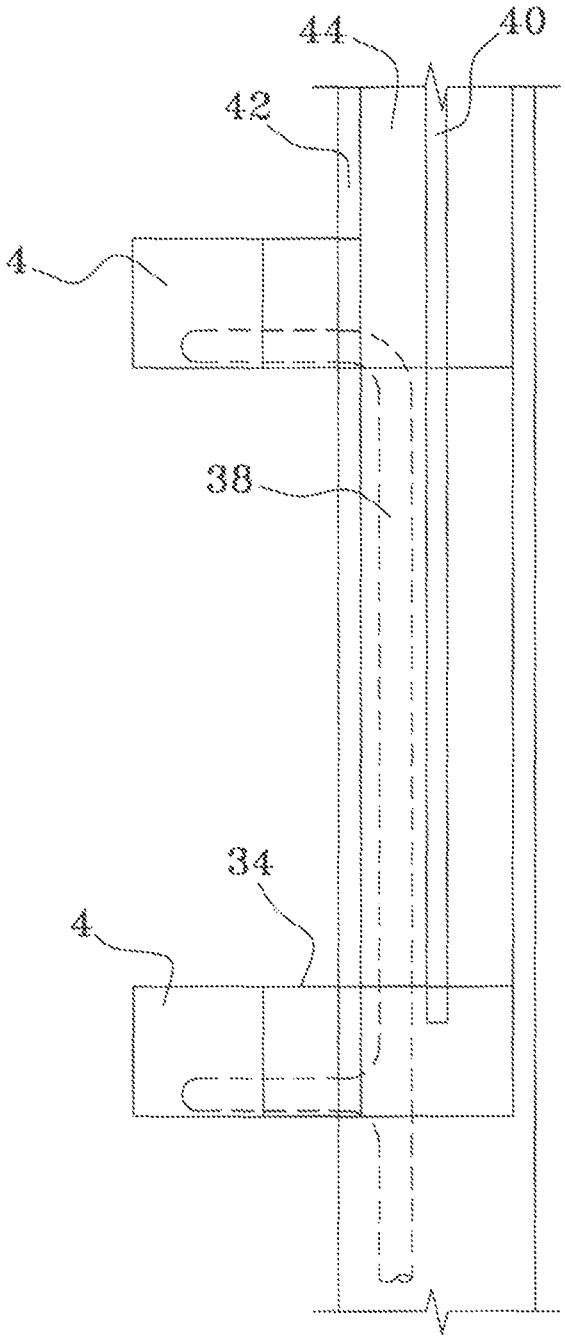
FIG. 14 is a cross sectional view of a radiator with side fluid fittings installed at a window.

FIGS. 13 and 14 depict the usage of two square radiators 4 about a large window. It can be seen that still only a single return line 38 (and supply line 36) is required. The location for the upper radiator can be field adjusted such that it aligns horizontally with any vision block of the window itself such as seams or mullions. In this way it remains visually and aesthetically unobtrusive.

Figure 15:
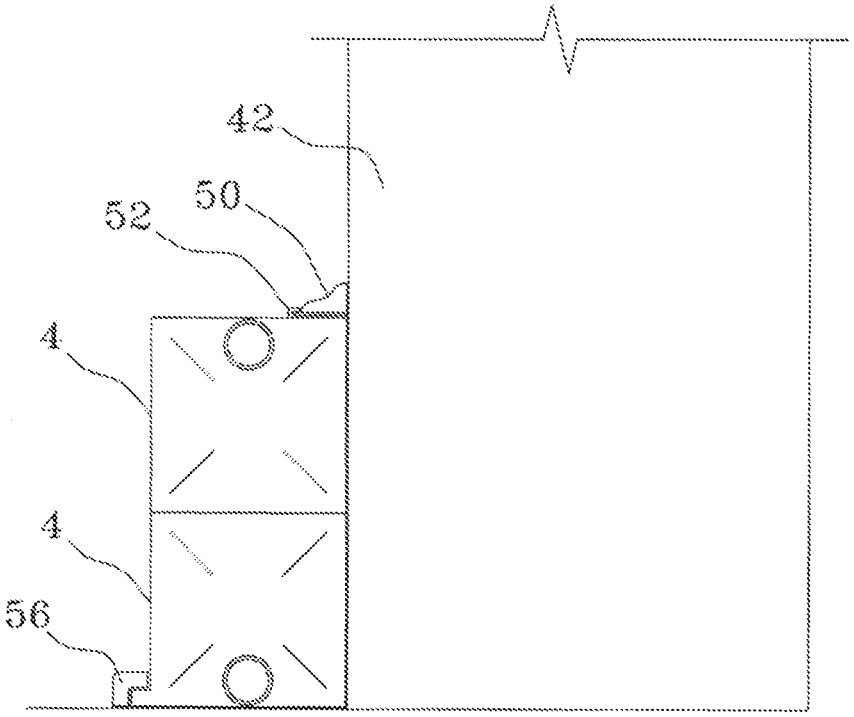
FIG. 15 is a side view of two square radiators with end fluid fittings coupled together and installed at a floor wall junction.
Figure 16:
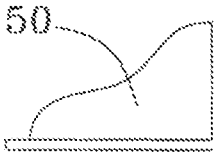
FIG. 16 is a cross sectional view of a decorative radiator wall support clip.

When the radiators are located at a distance from the source of heat loss or heat ingress, the temperature gradient across the primary heat transfer surface (the outer wall of the radiator shell) is reduced and the efficiency is reduced. Using medium temperature water in the 90 to 130 degree F. range, may require the coupling of two or more radiators in such locations. FIG. 15 shows such a coupling. The plumbing to these units will generally be in a parallel configuration for maximum heat/cooling output although series plumbing may be used in corner configurations where it would be desirable to have the inlet and return lines in the same chases. The mechanical fasteners for attachment of the rounded radiator 2 or the square radiator 4 are various and well known in the industry. This style of "baseboard mount" unit shall have an appearance similar to a large wooden baseboard. Such application of radiators are intended to offset wall and modest window losses, and shall only require a depth between one and two inches. Attachment to the wall may be sliding engagement between a channel 52 on the radiator 4 and a decorative molding 50 that is nailed to the wall 42. A decorative retaining baseboard 56 may be used to secure the lower end of the radiator.

The heat transfer boundary in the radiator is at the outer surface of the shell. Compared to the prior art radiators, the surface area of the transfer boundary is larger and the log mean temperature difference at the second cross flow connected radiator jumps up (increases) back to what it was at the inlet to the first radiator. In the prior art radiators, the amount of thermal energy that is transferred per unit length of travel continues to decrease. In the preferred embodiment system, this occurs only to the midpoint of the series, cross flow connected radiators where the separate radiators are cross connected. Here the amount of energy that is transferred per unit length of travel rises to the same value it had at the inlet to the first radiator. Looking again at FIGS. 17 and 18 it can be seen that the amount of energy transferred from the different sets of connected radiators would be represented by the area under the curves on the graphs.

Figure 19:
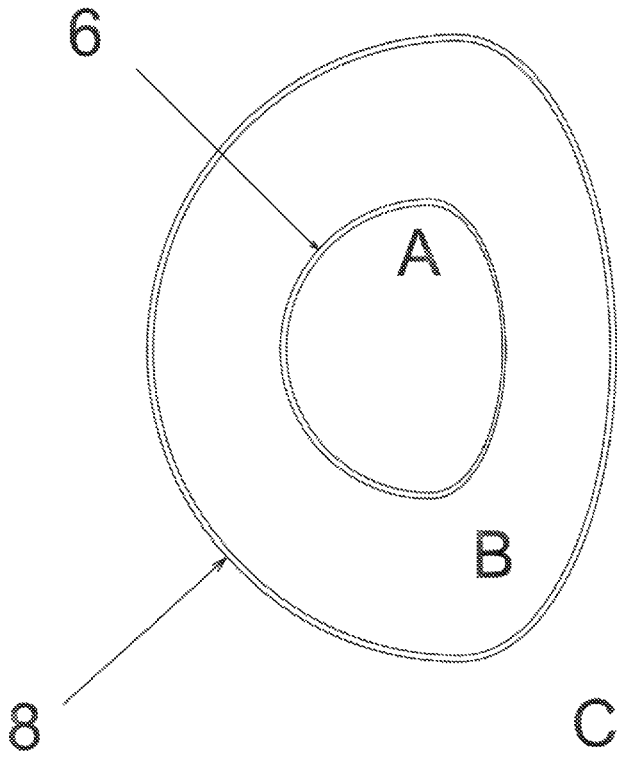
FIG. 19 is a central cross sectional view of the rounded (non symmetrical elliptical radiator) for purposes of energy transfer discussion.

Looking at FIG. 19 the energy transfer of the radiator can best be seen. In the prior art the heat energy transfer occurs between the water A and the water B with minimal energy transfer, if any, between water B and air C. (Any transfer of heat into the air is undesirable and is seen as an energy loss. For this reason, many of these style heat exchangers have a layer of thermal insulation between the shell 8 and the air.) There is never a conduit used to pass water A from one end of the radiator to the other end with no or minimal energy transfer. In the present improved radiator detailed herein, energy exchange occurs between water B and air 3 with minimal or no energy exchange between water A and water B and a conduit for passing water A from one end of the radiator to the other with no or minimal energy transfer. It is this design that allows the cross connection of two identical coupled radiators when additional heating or cooling is required.

The new and novel concept of this radiator is best explained in terms of it's energy impact. From thermodynamics it is known that heat transfer energy=heat transfer coefficient*surface area*temperature difference.

Energy transfer is improved in two ways. First in an improved heat transfer coefficient of thin walled extruded tube resulting from increased transfer of energy by spiraling the fluid against the inside wall, thereby extending the fluid path and simultaneously agitating the fluid. Second, heat transfer is improved by increasing the temperature difference over conventional radiators by locating the radiator directly adjacent and at the window side or sil where the largest temperature difference between the ambient air temperature and the radiator heat transfer surface exists. Currently heating radiators are usually placed in a baseboard location and radiant cooling panels are ceiling mounted. By locating the air conditioning device closer to the energy gain/loss source, the window, a greater temperature differential is achieved.

The result of this invention, combined with recent improvements in windows construction, now allow the improved radiator to satisfy all the window energy gain or loss. This results in a new HVAC airside system which provides significant fan, reheat and thermal energy savings. Fan energy is reduced because perimeter space airflow is lowered from about 2 CFM/SqFt down to 0.5 CFM/SqFt in well constructed buildings. This 75 percent reduction in airflow, translates into 75 percent reduction in perimeter served fan energy. Reheat energy is minimized as supply airflow is no longer reheated in the supply duct. Traditionally VAV terminals have minimum airflow of 0.4 CFM/SqFt in order to have adequate diffuser velocity so ceiling grille supplied warm air will get to the floor. With radiant heat, the minimum airflow is generally reduced down to 0.06 CFM/SqFt (plus 5 CFM per person) in most spaces. The third energy benefit is thermal energy advantage on spring and fall days. In mild weather, it is common for shaded windows to have energy loss, while sunny windows are having energy gain. Using a water-to-water heat pump, in combination with changeover valves at the radiators, the radiator's in cooling will offset the radiator's in heating providing outstanding energy savings. Using whole building computer energy analysis, a high efficiency 10,000 SqFt office building in Portland Oreg. would experience 29.9% reduction in fan energy, a 12.2% reduction in thermal (heat/cool) energy resulting from using radiant rather than reheat system, and the overall thermal energy savings is 26.8% when using improved radiators, water-to-water heat pumps and changeover valves.

To describe conduit application, typically a window is 3 to 5 feet wide and would be served by a pair of radiators, one mounted low to induce warming updraft against cold window, one mounted high to induce cooling downdraft against warm or sunny window. With this application the conduit is normally utilized for returning "spent" water in order that supply and return are at same end of the radiators. The pair of radiators serving a window could be installed in either series or parallel depending on window height and the capacity need of the window.

On larger windows 5 to 10 feet wide, traditional radiators have a diminished capacity. The improved radiator can be installed with a cross connection at the center, with the conduit utilized as a secondary supply path. This will provide capacity and efficiency of having two radiators installed end to end, but with each radiator piped in parallel, thereby increasing the overall capacity and efficiency.

It is known that the radiator shell may be constructed from a plethora of materials that meet the requirements of a high coefficient of heat transfer and thin wall economical construction such as aluminum, copper or other formed metals and plastics. The radiators of the present invention are intended to minimize space impact and have appearance matching traditional and contemporary building trim. While prime usage shall be mounting in close proximity to windows, a family of products including baseboard and pedestal models can incorporate the same solution concepts.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Having thus described the invention, what is claimed as new and desired to be secured by Letters Patent is as follows:

1. A freeze damage resistant heat exchanger comprising:

a shell;

a heat transfer surface on the outside of said heat exchanger body;

a heat transfer first fluid passing through said shell, said fluid having a volume;

an elastically deformable thermally insulated core tube within said shell, said core tube fabricated from a cross-linked high density polyethylene, said core tube having a wall thickness between 10% and 13% of a diameter of said core tube capable of an elastic deformation to accommodate up to a 7% increase in said volume;

a second fluid passing through said core tube; and wherein said core tube resides between said first fluid and said second fluid and minimizes the transfer of thermal energy between said fluids, and wherein said core tube can elastically deform and alter its own shape to accommodate volume changes within said heat exchanger due to the freezing of either said first fluid or said second fluid.

2. The freeze damage resistant heat exchanger of claim 1 wherein said shell has a rounded cross sectional.

3. The freeze damage resistant heat exchanger of claim 1 wherein said shell has a non-symmetrical elliptical transverse cross section.

4. The freeze damage resistant heat exchanger of claim 1 wherein said shell has a D shaped transverse cross section.

5. The freeze damage resistant heat exchanger of claim 1 further comprising an elastically deformable helix baffle within said shell residing unconnected between said core tube and said shell, wherein there exists a gap between said core tube and said helix baffle and a gap between an inside surface of said shell and said helix baffle.

6. The freeze damage resistant heat exchanger of claim 1 wherein said core tube is made of an elastically deformable polymer and has a wall thickness that is no less than 10% of the outside diameter of said core tube.

7. The freeze damage resistant heat exchanger of claim 4 wherein said shell is constructed of a highly thermally conductive material selected from the group consisting of copper, brass, aluminum, bronze, metal alloys and steel and has a wall thickness no less than 1% of the actual diameter of said shell.

8. The freeze damage resistant heat exchanger of claim 5 wherein said spiral baffle is made of an elastically deformable polymer with an EVOH oxygen diffusion barrier.

9. A freeze damage resistant heat exchanger comprising:

a shell containing a volume, said shell capable of a deformation to accommodate up to a 7% increase in said volume;

a heat transfer surface on the outside of said heat exchanger body;

a heat transfer first fluid passing through said heat exchanger body;

an elastically deformable thermally insulated core tube within said shell, said core tube fabricated from a cross-linked high density polyethylene, said core tube having a wall thickness between 10% and 13% of a diameter of said core tube;

a second fluid passing through said core tube; and wherein said core tube resides between said first fluid and said second fluid and minimizes the transfer of thermal energy between said fluids, and wherein said core tube can elastically deform and alter its own shape to accommodate volume changes within said heat exchanger due to the freezing of either said first fluid or said second fluid.

* * * * *